US007133036B2

(12) United States Patent
Martin et al.

(10) Patent No.: US 7,133,036 B2
(45) Date of Patent: Nov. 7, 2006

(54) DISPLAY WITH DATA GROUP COMPARISON

(75) Inventors: Eric T. Martin, Corvallis, OR (US); Andrew L. Van Brocklin, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 658 days.

(21) Appl. No.: 10/678,563

(22) Filed: Oct. 2, 2003

(65) Prior Publication Data

US 2005/0073510 A1 Apr. 7, 2005

(51) Int. Cl.
*G09G 5/00* (2006.01)

(52) U.S. Cl. ..... 345/204; 345/98

(58) Field of Classification Search ..... 345/84, 345/87, 98, 100, 204, 690, 697
See application file for complete search history.

(56) References Cited

U.S. PATENT DOCUMENTS

| | | | | |
|---|---|---|---|---|
| 4,851,840 | A | 7/1989 | McAulay | |
| 4,937,776 | A | 6/1990 | Myers et al. | |
| 5,206,629 | A * | 4/1993 | DeMond et al. | 345/98 |
| 5,504,855 | A | 4/1996 | Priem et al. | |
| 5,619,228 | A | 4/1997 | Doherty | |
| 6,064,404 | A * | 5/2000 | Aras et al. | |
| 6,201,521 | B1 * | 3/2001 | Doherty | 345/84 |
| 6,278,428 | B1 | 8/2001 | Smith et al. | |
| 2002/0005913 | A1 | 1/2002 | Morgan et al. | |
| 2003/0016213 | A1 | 1/2003 | Huang | |

FOREIGN PATENT DOCUMENTS

| | | |
|---|---|---|
| JP | 11131021 | 5/1999 |
| JP | 2002-149122 | 5/2002 |
| WO | WO 03/094362 | 11/2003 |

* cited by examiner

*Primary Examiner*—Regina Liang

(57) ABSTRACT

One aspect of the present invention provides a system for controlling display cells modulating light based on image data. The system comprises an input controller and a display controller. The input controller is configured to receive a series of image data groups with each image data group having N bits arranged in subgroups, wherein each subgroup has a subgroup value and a subgroup position corresponding to one cell of a group of cells. The input controller is configured to determine a comparison value for each subgroup position based on subgroup values at corresponding subgroup positions of a current image data group and a preceding image data group. The input controller is further configured to provide an update signal based on the comparison values, and to provide an update image data group having less than N bits and representative of the current image data group when the update signal indicates reduced data transmission. The display controller is configured to receive the update signal and the update image data group, and to update the group of cells based on the update signal with N bits of data from at least one of: the update data group, the preceding data group, and a function of the update and preceding data groups.

78 Claims, 9 Drawing Sheets

150

| | DESCRIPTION OF DATA | LIGHT MODULATING CELL | | | | | | | | |
|---|---|---|---|---|---|---|---|---|---|---|
| | | 0 | 1 | 2 | 3 | 4 | 5 | 6 | 7 | 8 |
| 156 | SUBGROUP DATA OF IMAGE DATA GROUP FOR PREVIOUSLY UPDATED ROW (ROW 0) | 0 x 1 | 0 x 3 | 0 x 5 | 0 x 7 | 0 x 9 | 0 x B | 0 x D | 0 x E | 0 x 0 |
| 152 | SUBGROUP DATA OF IMAGE DATA GROUP FOR CURRENT ROW TO BE UPDATED (ROW 1) | 0 x 1 | 0 x 3 | 0 x 4 | 0 x 6 | 0 x 9 | 0 x A | 0 x D | 0 x E | 0 x 0 |
| 158 | DATA BITS OF UPDATE SIGNAL ( "0" INDICATES IMAGE DATA NOT CHANGING) | 0 | 0 | 1 | 1 | 0 | 1 | 0 | 0 | 0 |
| 160 | SUBGROUP DATA OF UPDATE IMAGE DATA GROUP | NO DATA | NO DATA | 0 x 4 | 0 x 6 | NO DATA | 0 x A | NO DATA | NO DATA | NO DATA |
| 162 | IMAGE DATA PROVIDED TO LIGHT MODULATING CELLS OF CURRENT ROW TO BE UPDATED | 0 x 1 | 0 x 3 | 0 x 4 | 0 x 6 | 0 x 9 | 0 x A | 0 x D | 0 x E | 0 x 0 |

154

Fig. 3

250

| | DESCRIPTION OF DATA | LIGHT MODULATING CELL | | | | | | | | | |
|---|---|---|---|---|---|---|---|---|---|---|---|
| | | 0 | 1 | 2 | 3 | 4 | 5 | 6 | 7 | 8 | 254 |
| 256 | SUBGROUP DATA OF IMAGE DATA GROUP FOR PREVIOUSLY UPDATED ROW (ROW 0) | 0 x 1 | 0 x 3 | 0 x 5 | 0 x 7 | 0 x 9 | 0 x B | 0 x D | 0 x E | 0 x 0 | |
| 252 | SUBGROUP DATA OF IMAGE DATA GROUP FOR CURRENT ROW TO BE UPDATED (ROW 1) | 0 x A | 0 x 7 | 0 x 7 | 0 x 8 | 0 x 1 | 0 x E | 0 x 4 | 0 x E | 0 x F | |
| 258 | DATA BITS OF UPDATE SIGNAL ( "0" INDICATES DIFFERENCE DATA) | 1 | 1 | 0 | 0 | 1 | 0 | 1 | 0 | 1 | |
| 260 | SUBGROUP DATA OF UPDATE IMAGE DATA GROUP | 0 x A | 0 x 7 | 0 x 2 | 0 x 1 | 0 x 1 | 0 x 3 | 0 x 4 | 0 x 0 | 0 x F | |
| 262 | IMAGE DATA PROVIDED TO LIGHT MODULATING CELLS OF CURRENT ROW TO BE UPDATED | 0 x A | 0 x 7 | 0 x 7 | 0 x 8 | 0 x 1 | 0 x E | 0 x 4 | 0 x E | 0 x F | |

Fig. 5

350

| | | | | | |
|---|---|---|---|---|---|
| 1 | 2 | 3 | 4 | 5 | 6 |
| 7 | 8 | 9 | 10 | 11 | 12 |
| 13 | 14 | 15 | 16 | 17 | 18 |
| 19 | 20 | 21 | 22 | 23 | 24 |
| 25 | 26 | 27 | 28 | 29 | 30 |
| 31 | 32 | 33 | 34 | 35 | 36 |

Fig. 7A

360

| | | | | | |
|---|---|---|---|---|---|
| A | A | B | B | C | C |
| A | A | B | B | C | C |
| D | D | E | E | F | F |
| D | D | E | E | F | F |
| G | G | H | H | I | I |
| G | G | H | H | I | I |

Fig. 7B

DISPLAY WITH DATA GROUP COMPARISON

BACKGROUND

Digital projection systems generally utilize individual light modulating cells arranged to from some type of light modulating array to display an image, with each cell displaying at least a portion of a pixel in response to image data representative of the displayed image. Data updating, or refresh, schemes for such light modulating arrays typically involve updating each individual cell of the array with image data for each frame of the displayed image.

One refresh scheme employed when the individual cells of a light modulating array are arranged in rows and columns involves "writing" updated image data to each of the columns of the array and then enabling an update of the image data to each light modulating cell of a selected row. This process is repeated sequentially through each row to update the entire array with image data for a given frame. However, updating high-resolution digital projection systems in this fashion requires a high data rate to the array.

Consequently, system designers often expend significant effort on developing algorithms designed to decrease these high data rates. However, such algorithms often utilize image interpolation or other schemes that introduce color errors or other visual artifacts into the projected image, and can also limit image special resolution and color depth. Furthermore, even when employing such algorithms, each cell of the array is refreshed with new image data for each frame even though much of the individual cell data often does not change from frame-to-frame. Consequently, a significant portion of system bandwidth is often used in rewriting unchanged image data.

SUMMARY

One aspect of the present invention provides a system for controlling display cells modulating light based on image data. The system comprises an input controller and a display controller. The input controller is configured to receive a series of image data groups with each image data group having N bits arranged in subgroups, wherein each subgroup has a subgroup value and a subgroup position corresponding to one cell of a group of cells. The input controller is configured to determine a comparison value for each subgroup position based on subgroup values at corresponding subgroup positions of a current image data group and a preceding image data group. The input controller is further configured to provide an update signal based on the comparison values, and to provide an update image data group having less than N bits and representative of the current image data group when the update signal indicates reduced data transmission. The display controller is configured to receive the update signal and the update image data group, and to update the group of cells based on the update signal with N bits of data from at least one of: the update data group, the preceding data group, and a function of the update and preceding data groups.

BRIEF DESCRIPTION OF THE DRAWINGS

FIG. 3 is a diagram illustrating the operation of the display system of FIG. 2.

FIG. 5 is a diagram illustrating the operation of the display system of FIG. 4.

FIG. 7A is a diagram illustrating the operation of the display system of FIG. 6.

FIG. 7B is a diagram illustrating the operation of the display system of FIG. 6.

DETAILED DESCRIPTION

In the following Detailed Description, reference is made to the accompanying drawings which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments of the present invention can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1A:
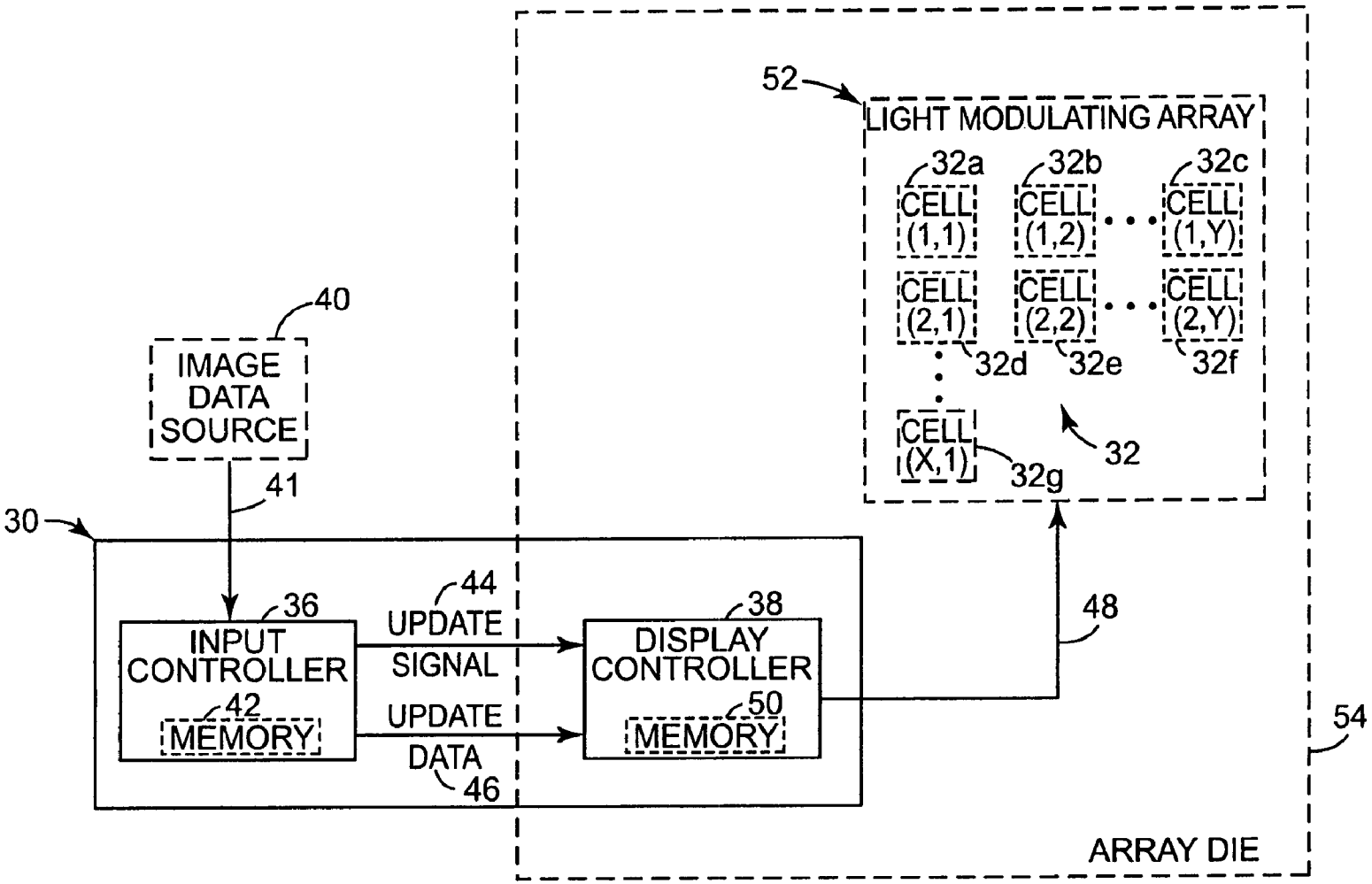
FIG. 1A is a diagram illustrating an exemplary embodiment of a system for controlling display cells according to the present invention.

FIG. 1A is a block diagram illustrating generally one exemplary embodiment of a data control system 30 according to the present invention for controlling a group of display cells 32 modulating light based on image data. System 30 includes an input controller 36 and a display controller 38. Input controller 36 receives a series of image data groups from an image data source 40 via a path 41. Each image data group comprises N bits arranged in subgroups, wherein each subgroup has a subgroup value and a subgroup position with each position corresponding to one cell of the group of display cells 32.

Input controller 36 determines a comparison value for each subgroup position based on a subgroup position values at corresponding subgroup positions of a current image data group and a preceding image data group. In one embodiment, the preceding image data group is stored at a memory 42 in input controller 36. Input controller 36 provides at 44 an update signal based on the comparison values, and provides at 46 an update image data group representative of the current image data group and having fewer than N bits when the update signal at 44 indicates reduced data transmission.

Display controller 38 receives the update signal at 44 and the update image data group at 46. Display controller 38 updates the group of display cells 32 based on the update signal with N bits of image data via a path 48, wherein the N bits of image data are from at least one of the following: the update data group, the preceding image data group, and a function of the update image and preceding image data groups. In one embodiment, the preceding image data group is stored in a memory 50 within display controller 38.

When the update signal does not indicate reduced data transmission, input controller 36 essentially passes N bits of a current image data group through to display controller 38, with the update image data group at 46 comprising the N bits of the current image data group. However, when the update signal indicates reduced data transmission, the update image data group at 46 is representative of the current image data group and comprises less than N bits, thereby reducing data transmission between input controller 36 and display controller 38.

In one embodiment, the group of light modulating cells 32, such as light modulating cells 32*a* to 32*g*, is configured to form an X-row by Y-column light modulating array 52. In one embodiment, display controller 38 and light modulating array 52 are part of an array die 54. When the update signal at 44 indicates reduced data transmission, data control system 30 according to the present invention reduces the amount of image data transferred to array die 54 from image data source 40 without compromising image quality caused by the introduction of visual artifacts produced by currently employed data input algorithms. Numerous implementations of the present invention exist, with several embodiments described in greater detail below to aid in explaining the operation of the present invention.

Figure 1B:
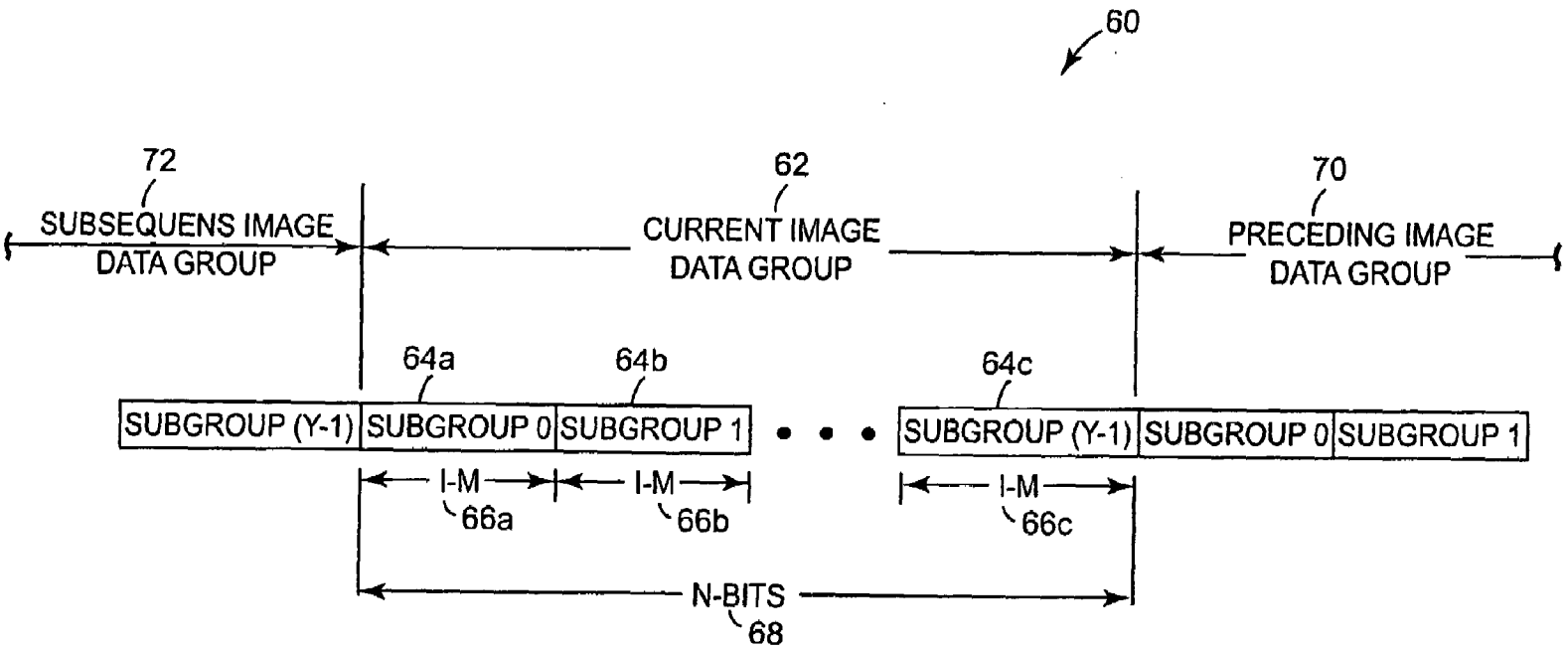
FIG. 1B is an illustrative diagram of an example data group.

FIG. 1B is an illustrative diagram 60 of an example image data group 62 as received at 40 by input controller 36 in FIG. 1A. In the illustrative diagram, image data group 62 is a current image data group for a given row of light modulating array 52 that is to be updated, and has Y subgroups 64*a*–64*c*, one subgroup corresponding to each cell of the given row to be updated. Each subgroup has from one to M image data bits 66*a*–66*c*, such that image data group 62 has a total of N image data bits 68. Image data group 62 is part of a series of image data groups received at 40 by input controller 36, including a preceding image data group 70 and a subsequent image data group 72, wherein each image data group comprises a row's worth of image data for light modulating array 52. In other embodiments, image data group 62 comprises data for each cell of light modulating array and, thus, has a quantity of subgroups equal to the product of X multiplied by Y.

Figure 2:
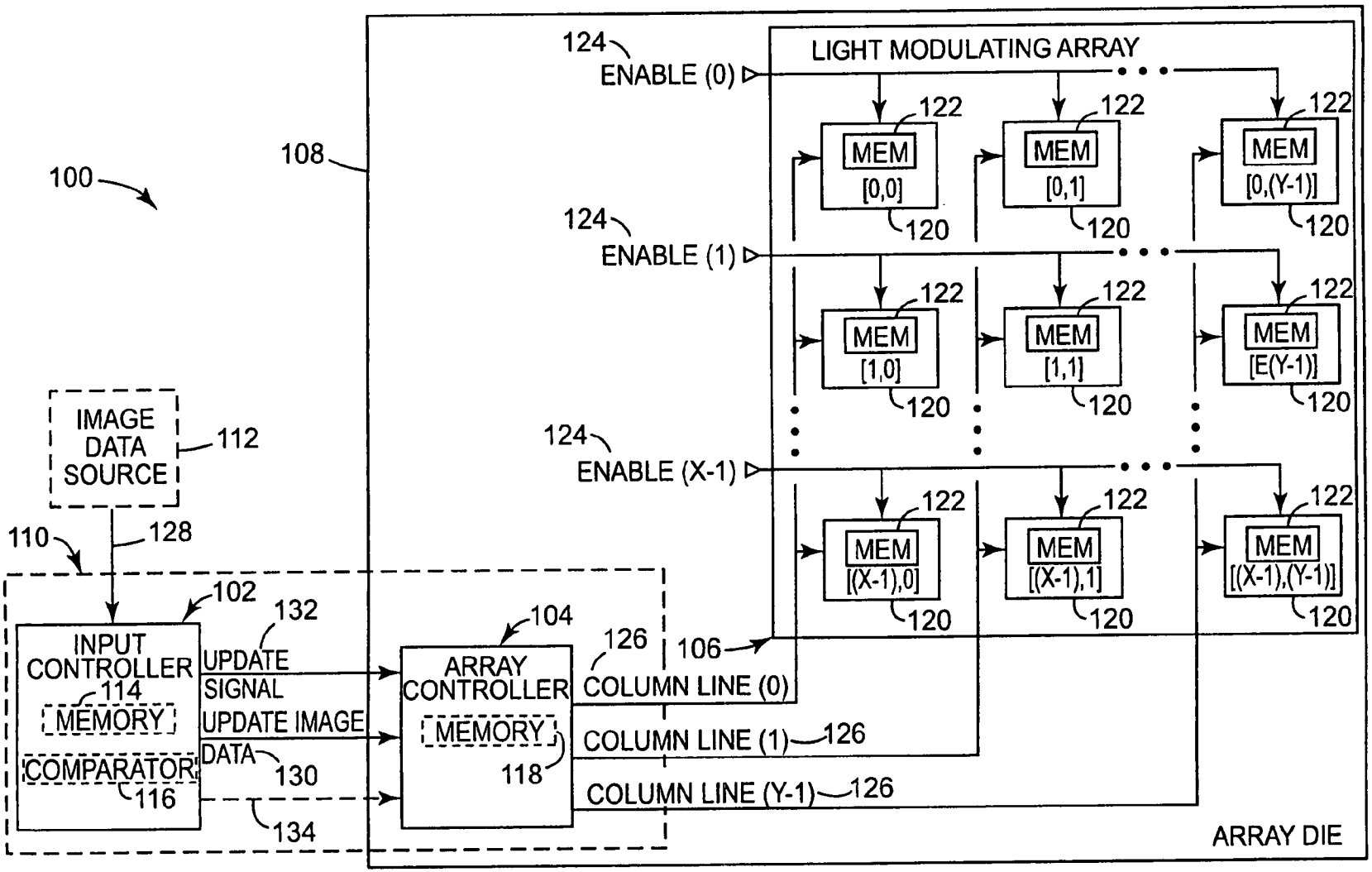
FIG. 2 is a block diagram illustrating one exemplary embodiment of a display system according to the present invention.

FIG. 2 is a block diagram illustrating one exemplary embodiment of a display system 100 according to the present invention. Display system 100 includes an input controller 102, an array controller 104, and a light modulating array 106. Array controller 104 and light modulating array 106 are located on an array die 108. Input controller 102 and array controller 104 together form a system 110 for reducing an amount image data transferred from an image data source 112 to array die 108, wherein the image data is representative of a displayable image to be displayed via light modulating array 106.

Input controller 102 includes a memory 114 and a comparator 116. Array controller 104 includes a memory 118. Light modulating array 106 comprises an X-row by Y-column array of light modulating cells 120, with each light modulating cell 120 further including a memory 122. Each light modulating cell 120 is configured to display, at least partially, a pixel of a the displayable image, with each light modulating cell modulating light based on image data stored in associated memory 122.

Light modulating array 106 is updated with image data from frame-to-frame of the displayable image to reflect changes that occur in the displayable image from frame-to-frame. Each row of the X rows of light modulating array 106 receives a separate enable signal 124 for a total of X enable signals, with all light modulating cells 120 of a given row receiving a same enable signal. Each light modulating cell 120 of the given row of light modulating array 106 to be updated receives image data from array controller 104 via a separate column line 126 for a total of Y column lines.

In one embodiment, light modulating array is 106 is updated in a row-wise fashion, wherein image data of a current frame of the displayable image is placed by array controller 104 on each of the Y columns lines 126. An enable signal 124 is then provided to a given row of light modulating array 106 that is the first to be updated, and the image data on each of the Y column lines 126 is written to a memory 122 of a corresponding light modulating cell 120. This process is repeated until the light modulating cells 120 of each of the X rows of light modulating array 106 is updated with an image data representative of the current frame of the displayable image. In one embodiment, light modulating array 106 is updated in a sequential fashion, beginning with row "0" and ending with row "X-1."

In the illustrated embodiment, input controller 102 receives at 128 a series of image data groups representative of the displayable image, wherein each data group corresponds to a single row of the X rows of light modulating array 106. Each image data group, or row of data, further comprises Y image data subgroups, with each of the Y image data subgroup having a subgroup value and each corresponding to one of the Y light modulating cells 120 of the single row.

Comparator 116 compares each subgroup value for each light modulating cell 120 of a current row that is to be updated to a subgroup value of a corresponding light modulating cell 120 of a previously updated row that is stored in memory 114. Input controller 102 provides an update image data group at 130 comprising only image data subgroups corresponding to light modulating cells 120 of the current row having subgroup values not matching the subgroup values of corresponding light modulating cells 120 of the previously updated row. Input controller 102 further provides an update signal at 132 indicating which light modulating cells 120 of the present row have subgroup values matching, and which light modulating cells 120 of the present row have subgroup values not matching the subgroup values of the corresponding light modulating cells 120 of the previously updated row. In one embodiment, subgroup values are deemed to match one another when they are equal to one another. In one embodiment, subgroup values are deemed to match when they are within a predetermined range of one another.

Array controller 104 receives the update image data group at 130 and the update signal at 132. Based on the update signal, array controller 104 places data subgroups from the update image data group on column lines 126 corresponding to light modulating cells 120 where the subgroup values of the current row to be updated and the previously updated row did not match. Array controller 104 places data subgroups from the image data group of the previously updated row, stored in memory 118, on columns lines 126 corresponding to light modulating cells 120 where the subgroup values of the current row to be updated and the previously updated row matched.

In one embodiment, the update signal comprises one bit corresponding to each of the Y cells of current row to be updated for a total of Y bits, with a state of each it indicating whether the cells is to be updated with "new" image data from the update image data group or with "old" image data from the image data group of the previously updated row. For instance, a bit having a value of "1" indicates that the light modulating cell is to be updated with image data from the update image data group, while a value of "0" indicates that the cell is to be updated with image date from the image data group for the previously updated row. In one embodiment, the subgroups of the update image data group and the bits of the update signal are provided in order from the last light modulating cell of the row, cell "Y", to the first light modulating cell of the row, cell "1."

The update image data group is transferred from input controller 102 to array controller 104 using a type of transfer scheme that optimize data rate. In one embodiment, the update image data group is transferred using a direct bit map. In one embodiment, the update image group is transferred using a run-length encoded signal. In one embodiment, input controller 102 determines which type of transfer scheme to employ based on the update image data group, and indicates provides a transfer signal via a line 134 to array controller 104 indicating which transfer scheme will be employed.

By providing only those image data subgroups of the image data group for the current row to be updated that do not match corresponding subgroups of the image data group for the previously updated row, display system 100 according to the present invention reduces the amount of image data transferred to array die 108 from image data source 112, thereby reducing update times associated with frame updates of light modulating array 106. In the case when the displayable image is a still photo, data transfer rates would be reduced to near zero. Furthermore, since no visual artifacts are produced, image quality is not reduced.

FIG. 3 is a table 150 of an example illustrating the operation of display system 100 illustrated in FIG. 2. In the example illustrated by table 150, light modulating array 106 comprises at least two rows ($X \geqq 2$) and has nine columns ($Y=9$). An image data group for a current row to updated, "Row 1" in the example, is shown at 152 and comprises nine subgroups, with one subgroup corresponding to one cell of the current row of cells of light modulating array 106, indicated as cells zero through eight at 154. An image data group for a previously updated row, "Row 0" in the example, is shown at 156, and again comprises nine subgroups, with one subgroup corresponding to one cell of the previously updated row of cells of light modulating array 106. Data illustrated in table 150 is in hexadecimal form.

Input controller 102 receives the image data group 152 from image data source 112 at 128. Comparator 116 then compares image data group 152 to image data group 156 stored in memory 114. Input controller 102 provides an update signal, as shown at 158, having one bit corresponding to each light modulating cell 154 of the row to be updated. A state of each bit depends on whether the subgroup data of image data group 152 matches the subgroup data of image data group 156, with a "0" indicating a match and a "1" indicating there was not a match. As indicated at 158, the update signal bits corresponding to light modulating cell positions 0, 1, 4, 6, 7 and 8 have a "0" state indicating a match, and the bits corresponding to light modulating cell positions 2, 3, and 5 have a "1" state indicating there was not a match. Thus, the update signal provided by input controller 102 at 132 would be "000101100" with the most significant bit (MSB) corresponding to light modulating cell "8" and the least significant bit corresponding to light modulating cell "0."

Input controller 102 further provides an update image group, as shown at 160, comprising those subgroups of image data group 152 corresponding to those light modulating cells 154 where the subgroups of image data groups 152 and 156 did not match. Accordingly, as indicated at 160, the update image group includes subgroups only for light modulating cells 2, 3, and 5. Thus, the update image data group provided by input controller 102 at would be "0×A, 0×6, 0×4."

Array controller 104 receives the update signal at 132 and the update image data group at 130. Array controller 106 provides subgroups from update image data group 160 via column lines 126 to those light modulating cells 154 where the corresponding bit of update signal 158 is a "1." Array controller 106 provides subgroups from image data group 156 stored in memory 118 via columns lines 126 to those light modulating cells 154 where the corresponding bit of update signal 158 is a "0." The image data provided to light modulating cells 154 of the current row to be updated is shown at 162. The subgroup data written to the corresponding memory 122 of each light modulating cell 120 of "Row 1" of the light modulating array 106 is indicated at 162.

This process is repeated sequentially for each row of light modulating array 106 until each light modulating cell 120 of light modulating array 106 is updated with data of a current frame of the displayable image. In the example illustrated by table 150, system 110 according to the present invention reduces by two-thirds (excluding data transferred via the update signal) the amount of data transferred to array die 108 from image data source 108. Furthermore, since no visual artifacts are produced, image quality is not reduced.

Figure 4:
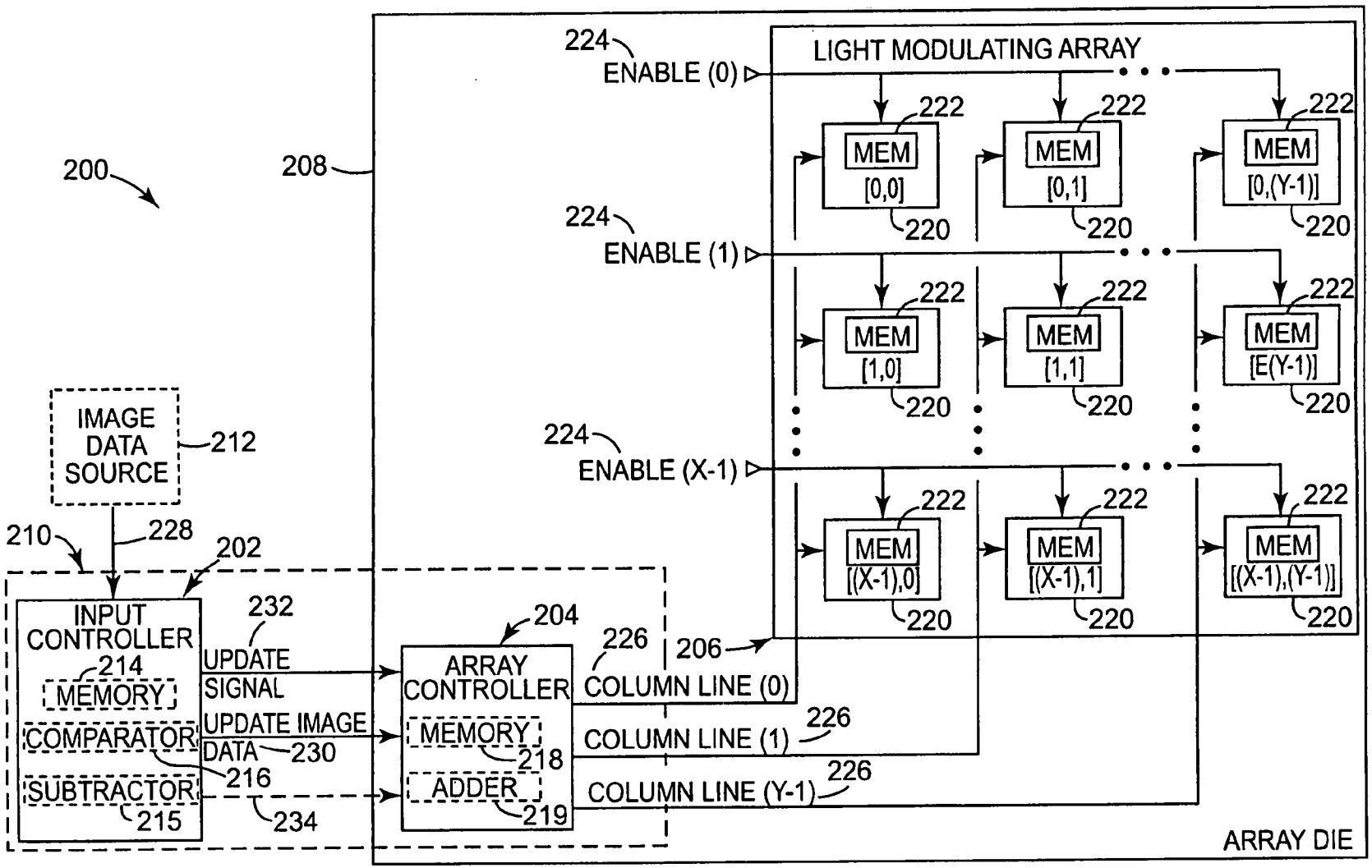
FIG. 4 is a block diagram illustrating one exemplary embodiment of a display system according to the present invention.

FIG. 4 is a block diagram illustrating one exemplary embodiment of a display system 200 according to the present invention. Display system 200 includes an input controller 202, an array controller 204, and a light modulating array 206. Array controller 204 and light modulating array 206 are located on an array die 208. Input controller 202 and array controller 204 together form a system 210 for reducing an amount image data transferred from an image data source 212 to array die 208, wherein the image data is representative of a displayable image to be displayed via light modulating array 206.

Input controller 202 includes a memory 214, a subtractor 215, and a comparator 216. Array controller 204 includes a memory 218 and an adder 219. Light modulating array 206 comprises an X-row by Y-column array of light modulating cells 220, with each light modulating cell 220 further including a memory 222. Each light modulating cell 220 is configured to display, at least partially, a pixel of the displayable image, with each light modulating cell modulating light based on image data stored in associated memory 222.

Light modulating array 206 is updated with image data from frame-to-frame of the displayable image to reflect changes that occur in the displayable image from frame-to-frame. Each row of the X rows of light modulating array 206 receives a separate enable signal 224 for a total of X enable signals, with all light modulating cells 220 of a given row receiving a same enable signal. Each light modulating cell 220 of the given row of light modulating array 206 to be updated receives image data from array controller 204 via a separate column line 226 for a total of Y column lines.

In one embodiment, light modulating array is 206 is updated in a row-wise fashion, wherein image data of a current frame of the displayable image is placed by array controller 104 on each of the Y columns lines 226. An enable signal 224 is then provided to a given row of light modulating array 206 that is the first to be updated, and the image data on each of the Y column lines 226 is written to a memory 222 of a corresponding light modulating cell 220. This process is repeated until the light modulating cells 220 of each of the X rows of light modulating array 206 is updated with an image data representative of the current frame of the displayable image. In one embodiment, light modulating array 206 is updated in a sequential fashion, beginning with row "0" and ending with row "X-1."

In the illustrated embodiment, input controller 202 receives at 228 a series of image data groups representative of the displayable image, wherein each data group corresponds to a single row of the X rows of light modulating array 206. Each image data group, or row of data, comprises Y image data subgroups, with each of the Y image data subgroups having a subgroup value and each corresponding to one of the Y light modulating cells 220 of the row.

Subtractor 215 determines a difference value between each subgroup value of a current row of data and a subgroup value of a preceding row of data corresponding to a same light modulating cell 220. The preceding row of data is stored in memory 214. Comparator 216 compares an absolute value of each difference value to a threshold value. The threshold value is value such that the number of bits required to convey the difference value is less than the number of bits required to convey the subgroup data to which it is associated.

Input controller 206 provides an update signal at 232 indicating which subgroups of the current data frame have an associated difference value less than the threshold value and which have an associated difference value not less than the threshold value. Input controller 206 further provides an update image data group at 230. The update image data group comprises subgroups from the current row of data having associated difference values not less than the threshold value and the difference values only for subgroups having a difference value less than the threshold value.

In one embodiment, the update signal comprises one bit corresponding to each of the Y cells of the current row to be updated for a total of Y bits. A state of each bit indicates whether the associated subgroup of the update image group is a subgroup from the current row of data or only a difference value. For instance, a bit having a value of "1" indicates that the associated subgroup of the update image data group is a subgroup of the current row of data, while a value of "0" indicates that the associated subgroup of the update image data group is a difference value. In one embodiment, the subgroups of the update image data group and the bits of the update signal are provided in order from the last light modulating cell of the row, cell "Y-1", to the first light modulating cell of the row, cell "0."

Array controller 204 receives the update image data group at 230 and the update signal at 232. Based on the update signal, array controller 204 places data subgroups from the update image data group that are subgroups of the current row of data directly on the appropriate column lines 226. For each subgroup of the update image data group that is a difference value, adder 219 adds the difference value to a corresponding data group of the preceding row of data stored in memory 218. Array controller 204 then places the sum of this operation on the appropriate column lines 226.

The update image data group is transferred from input controller 202 to array controller 204 using a type of transfer scheme that optimizes data rate. In one embodiment, the update image data group is transferred using a direct bit map. In one embodiment, the update image group is transferred using a run-length encoded signal. In one embodiment, input controller 202 determines which type of transfer scheme to employ based on the update image data group, and indicates provides a transfer signal via a line 234 to array controller 204 indicating which transfer scheme will be employed.

By providing only those bits representative of a difference for subgroups of a current image data group having an associated difference value less than a threshold value, display system 200 according to the present invention reduces the amount of image data transferred to array die 208 from image data source 212, thereby reducing update times associated with frame updates of light modulating array 206. Furthermore, since no visual artifacts are produced, image quality is not reduced.

FIG. 5 is a table 250 representing an example illustrating the operation of display system 200 of FIG. 4. In the example illustrated by table 250, light modulating array 206 comprises at least two rows ($X \geqq 2$) and has nine columns ($Y=9$). An image data group for a current row to be updated, "Row 1" in the example, is shown at 252. Image data group 252 comprises nine subgroups, with one subgroup corresponding to one cell 220 of the current row of cells of light modulating array 206 to be updated, indicated as cells zero through eight at 254. An image data group for a previously updated row, "Row 0" in the example, is indicated at 256, and also comprises nine subgroups, with one subgroup corresponding to one cell of the previously updated row of cells 220 of light modulating array 206. Data illustrated in table 250 is in hexadecimal form.

Input controller 102 receives image data group 252 from image data source 212 at 228. Subtractor 215 subtracts each subgroup of previous image update group 256 from the corresponding subgroup of current image data group 252 to determine a difference value corresponding to each subgroup of current image data group 252. Comparator 216 then compares an absolute value of each difference value to a threshold value. For illustrative purposes, a threshold value of "4" is used in the example of FIG. 5.

Input controller provides an update signal at 232 and an update image data group at 230 based on the comparison. The update signal, as shown at 258, has one bit corresponding to each light modulating cell 154 of the row to be updated. A state of each bit depends on whether the difference value associated with each subgroup of update image data group 252 is less than, or not less than, the threshold value. A bit having a value of "1" indicates that the difference value associated with that subgroup was not less than the threshold value, while a bit having a value of "0" indicates that the difference value associated with that subgroup was less than the threshold value. As indicated at 258, the update signal bits corresponding to light modulating cell positions 0, 1, 4, 6, and 8 have a value of "1", indicating a corresponding difference value not less than the threshold value, while the bits corresponding to cell positions 2, 3, 5, and 7 have a value of "0", indicating a corresponding difference value less than the threshold value. Thus, the update signal provided by input controller 202 at 232 would be "101010011" with the MSB corresponding to light modulating cell "8" and the LSB corresponding to light modulating cell "0."

Input controller 202 further provides an update image data group, as shown at 260. Image update data group 260 comprises subgroups of the current image data group having corresponding difference values not less than the threshold value and the difference values only for subgroups of the current image data group having associated difference values not less than the threshold. Accordingly, update data group 260 provided by input controller 202 would appear as "0×A, 0×7, 0×2, 0×1, 0×1, 0×3, 0×4, 0×0, 0×F".

Array controller 204 receives the update signal at 232 and the update image data group at 130. Based on the update signal, array controller 204 provides subgroups from update image data group 260 via column lines 226 to those light modulating cells 154 where the corresponding bit of update signal 158 has a value of "1." Where the bit of update signal 158 has a value of "0", adder 219 adds the corresponding difference value from update image data group 260 to the corresponding subgroup of update image data group 256 stored in memory 218. Array controller 204 places the sum of this addition via column lines 226 to the corresponding light modulating cells 154. The subgroup data written to the corresponding memory 222 of each light modulating cell 220 of "Row 1" of the light modulating array 206 is indicated at 262.

This process is repeated sequentially for each row of light modulating array 206 until each light modulating cell 220 is updated with image data of a the current frame of the displayed image. In the example illustrated by table 250, by transferring only the difference data for light modulating cells 2, 3, 5, and 7, system 110 according to the present invention reduces the amount of data transferred to array die 208 from image data source 212.

However, it is should be noted that in rare situations where a significant portion of the subgroup data for light modulating cells 222 changes from one frame to the next, the embodiment of the present invention as described and illustrated by FIG. 4 and FIG. 5 above does not provide a reduction in data rate to array die 208. In such situations, however, the maximum spatial resolution of light modulating array 206 that is perceivable to a user is significantly diminished, and the spatial resolution of light modulating array can be lowered without a perceivable decrease in image quality.

One scheme for lowering the spatial resolution of light modulating array 206 is to provide a same image data subgroup to multiple light modulating cells 220 as opposed to sending a separate image data subgroup to each light modulating cell 220. Providing fewer image data subgroups results in a decrease in the data rate to array die 208 without a perceived decrease in the quality of an image displayed by light modulating array 206. Such a scheme is described in more detail below by FIG. 6.

Figure 6:
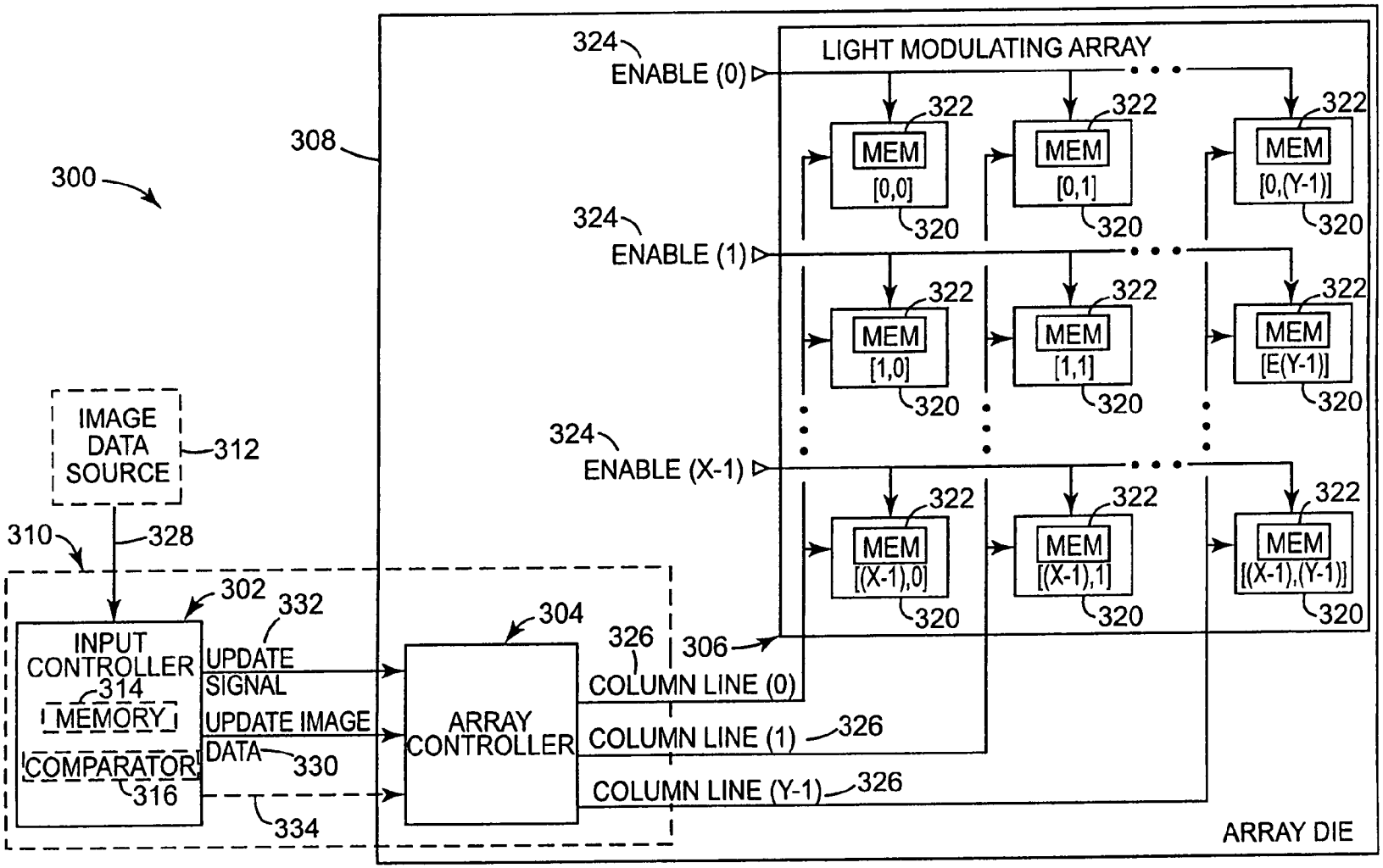
FIG. 6 is a block diagram illustrating one exemplary embodiment of a display system according to the present invention.

FIG. 6 is a block diagram illustrating one exemplary embodiment of a display system 300 according to the present invention. Display system 300 includes an input controller 302, an array controller 304, and a light modulating array 306. Array controller 304 and light modulating array 306 are located on an array die 308. Input controller 302 and array controller 304 together form a system 310 for reducing an amount image data transferred from an image data source 312 to array die 308, wherein the image data is representative of a displayable image to be displayed by light modulating array 306.

Input controller 302 includes a memory 314 and a comparator 316. Light modulating array 306 comprises an X-row by Y-column array of light modulating cells 320, with each light modulating cell 320 further including a memory 322. Each light modulating cell 320 is configured to display, at least partially, a pixel of a the displayable image, with each light modulating cell modulating light based on image data stored in associated memory 322.

Light modulating array 306 is updated with image data from frame-to-frame of the displayable image to reflect changes that occur in the displayable image from frame-to-frame. Each row of the X rows of light modulating array 306 receives a separate enable signal 324 for a total of X enable signals, with all light modulating cells 320 of a given row receiving a same enable signal. Each light modulating cell 320 of the given row of light modulating array 306 to be updated receives image data from array controller 304 via a separate column line 326 for a total of Y column lines.

In one embodiment, light modulating array is 306 is updated in a row-wise fashion, wherein image data representative of a current frame of the displayable image is placed by array controller 104 on each of the Y columns lines 326. An enable signal 324 is then provided to a given row of light modulating array 306 that is the first to be updated, and the image data on each of the Y column lines 326 is written to a memory 322 of a corresponding light modulating cell 320. This process is repeated until the light modulating cells 320 of each of the X rows of light modulating array 306 is updated with an image data representative of the current frame of the displayable image. In one embodiment, light modulating array 306 is updated in a sequential fashion, beginning with row "0" and ending with row "X-1."

In the illustrated embodiment, input controller 302 receives at 328 a series of image data groups representative of the displayable image, wherein each data group corresponds to a frame of data for light modulating array 306. Each image data group, or data frame, includes a total number of subgroups (N) equal to the product of X multiplied by Y, with each subgroup having a subgroup value and corresponding to one light modulating cell 320 of light modulating array 306.

Comparator 316 compares each subgroup value of each of the N subgroups of a current data frame to a subgroup value of a subgroup of a previous data frame corresponding to a same light modulating cell 322. Input controller 302 provides an update signal at 322 having a first state when a percentage of the N subgroups having subgroup values not matching corresponding subgroup values of the previous data frame is not greater than a threshold percentage, and a second state when the percentage exceeds the threshold percentage.

Comparator 116 provides an update image data group comprising less than N subgroups when the update signal has the first state, wherein each subgroup has a subgroup value based on and representative of the subgroups of the current data frame. Comparator 116 provides an update image data group at 330 comprising the N subgroups of the current data frame when the update signal has the second state. In one embodiment, when the update image data group comprises less than N subgroups, the less than N subgroups comprises a predetermined group of data subgroups of the current data frame. In one embodiment, when the update image data group comprises less than N subgroups, each of the less than N subgroups has a subgroup value that is an average value of the subgroup values of a group of subgroups of the current data frame corresponding to a predetermined group of light modulating cells 322.

Array controller 104 receives the update image data group at 130 and the update signal at 132. When the update signal has the first state, array controller 304 updates light modulating array 306 in a row-wise fashion writing each of the less than N subgroups of the update image data group to a predetermined group of light modulating cells 322 of light modulating array 306. When the update signal has the second state, array controller 304 updates light modulating array 306 in a row-wise fashion writing each subgroup of the current data frame to memory 322 of its corresponding light modulating cell 322.

The update image data group is transferred from input controller 102 to array controller 104 using a type of transfer scheme that optimize data rate. In one embodiment, the update image data group is transferred using a direct bit map. In one embodiment, the update image group is transferred using a run-length encoded signal. In one embodiment, input controller 102 determines which type of transfer scheme to employ based on the update image data group, and indicates provides a transfer signal via a line 134 to array controller 104 indicating which transfer scheme will be employed.

By transferring fewer than the total number of subgroups of a data frame when a significant portion of the subgroups are changing from one data frame to the next, display system 300 according to the present invention reduces the amount of image transferred to array die 308 from image data source 312. While this technique lowers the spatial resolution of light modulating array 306, the decrease in resolution is not perceivable to a user.

FIGS. 7A and 7B are diagrams of an example illustrating the operation of display system 300 illustrated by FIG. 6. In the illustrated example, light modulating array 306 is a 6-row by 6-column array having a total (N) of thirty-six light modulating cells 320. FIG. 7A illustrates at 350 the 6×6 light modulating array 306, with each cell labeled as one through thirty-six. Assume in the example that the percentage of subgroups with image data changing from one frame to the next exceeds the threshold percentage. In this situation, input controller 302 provides an update signal at 302 having the first state and provides less than N (i.e., less than 36) subgroups to array controller 304 via the update image data group at 330.

In the illustrative example, as shown at 360 in FIG. 7B, input controller 302 provides to array controller 304 only nine image data subgroups, labeled as subgroups A through I. Array controller 304 provides each of the nine image data subgroups to a predetermined group of four light modulating cells 320 of light modulating array 306. As illustrated by FIG. 7B, array controller 304 provides subgroup A to light modulating cells 1,2, 7 and 8; subgroup B to cells 3, 4, 9, and 10; subgroup C to cells 5, 6, 11, and 12; subgroup D to cells 13, 14, 19, and 20; subgroup E to cells 15, 16, 21, and 22; subgroup F to cells 17, 18, 23, and 24; subgroup G to cells 25, 26, 31, and 32; subgroup H to cells 27, 28, 33, and 34; and subgroup I to cells 29, 30, 35, and 36.

In one embodiment, each of the nine subgroups A through I comprises an average value of the four subgroups of the current data frame corresponding to the four light modulating cells 322 of light modulating array 306 to which each of the nine subgroups is provided by array controller 304. For example, in one embodiment, subgroup A comprises the average value of the subgroups of the current data frame corresponding to light modulating cells 1, 2, 7, and 8. In one embodiment, each of the nine subgroups A through I comprises one subgroup of the four subgroups of the current data frame corresponding to the four light modulating cells 322 of light modulating array 306 to which each of the nine subgroups is provided by array controller 304. For example, in one embodiment, subgroup A comprises the image data of the subgroup of the current data frame corresponding to light modulating cell "1."

In the illustrative example of FIGS. 7A and 7B, by providing only nine image data subgroups in lieu of thirty-six, display system 300 according to the present invention reduces by 75% the amount of image data transferred to array die 308 from image data source 312. While this technique lowers the spatial resolution of light modulating array 306, the decrease in resolution is not perceivable to a user.

Figure 8:
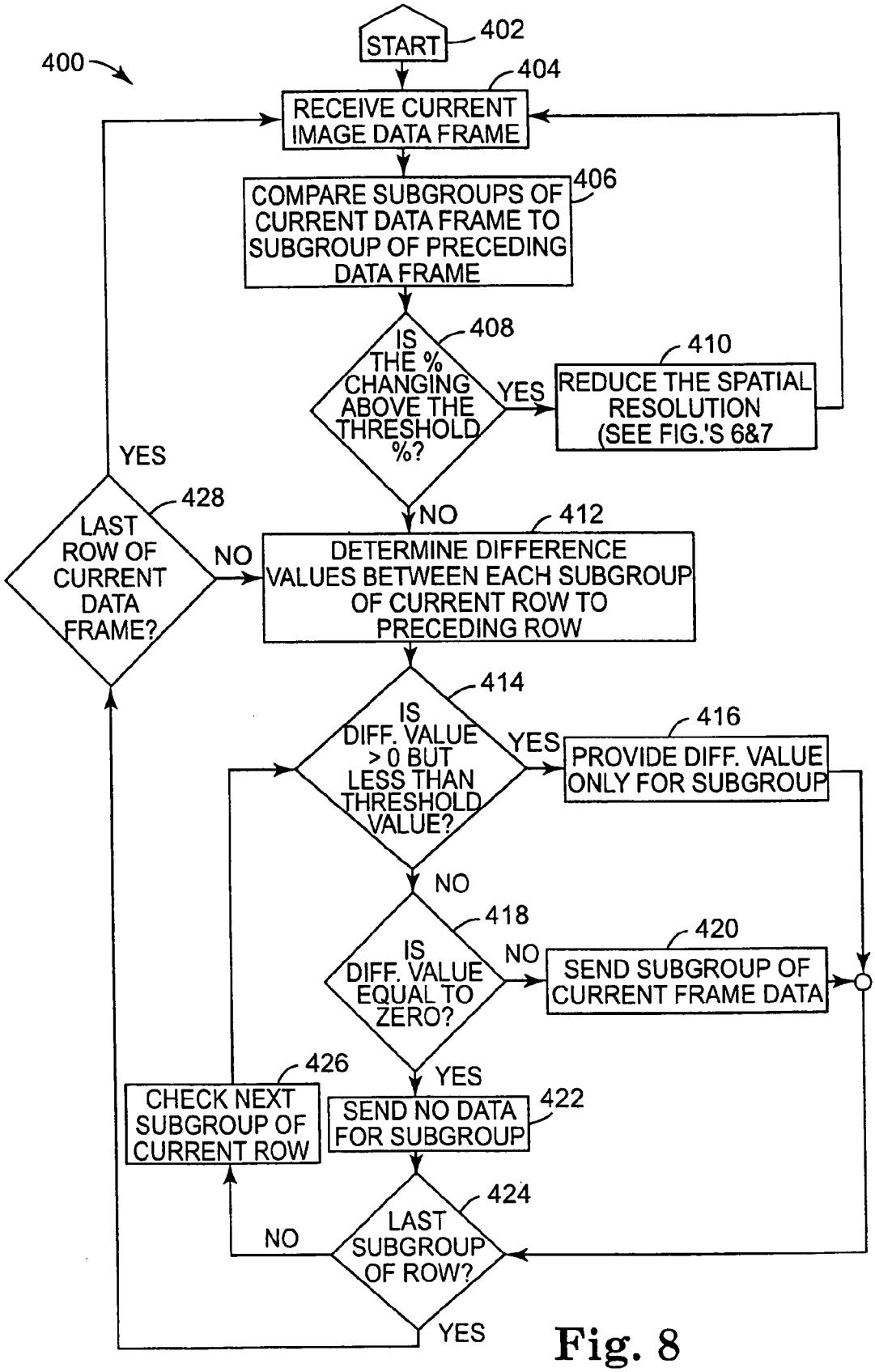
FIG. 8 is a flow diagram illustrating the operation of one exemplary embodiment of a display system according to the present invention.

While described independently, the embodiments illustrated by FIGS. 2–7B could potentially be combined to form a single display system. FIG. 8 is a flow diagram illustrating one exemplary embodiment of a process 400 that could potentially be employed by a display system according to the present invention that combines the embodiments illustrated above by FIGS. 2–7B. Reference is also made to FIG. 1.

Process 400 begins as indicated at 402. At step 404, input controller 36 receives a current frame of image data representative of an image to be displayed by light modulating array 54. At step 406, in a fashion illustrated by FIGS. 6, 7A, and 7B, input controller 36 compares each subgroup value of the current frame of image data to a corresponding subgroup value of a preceding frame of image data. At step 408, process 400 queries whether a percentage of subgroup values from the current frame not matching corresponding subgroup values of the preceding frame is above a threshold percentage. If the answer is "yes", process 400 at step 410 reduces the spatial resolution of light modulating array 52 in a fashion similar to that illustrated by FIGS. 6, 7A, and 7B. Process 400 then returns to step 404 to receive the next frame of image data.

If the answer to the query at step 408 is "no", process 400 proceeds to step 412 where a row-by-row comparison of image data subgroups begins. At step 412, input controller determines a difference value between each subgroup value of the current row of image data and a corresponding subgroup value of a preceding row of image data. At step 414, in a fashion illustrated by FIGS. 4 and 5, process 400 queries whether a difference value associated with a given subgroup of the current row of image data is greater than zero but less than a predetermined threshold difference value. If the answer is "yes", process 400 proceeds to step 418 where only the difference value associated with the given subgroup is provided to display controller 38 via path 46, in a fashion similar to that illustrated by FIGS. 4 and 5. Process 400 then proceeds to step 424.

If the answer to the query at step 414 is "no", process 400 proceeds to step 418. At step 418, process 400 queries whether the difference value associated with the given subgroup of the current row of image data is equal to zero. If the answer is "no", process 400 proceeds to step 420, where the given subgroup of the current row of image data is provided to display controller 38 via path 46, in a fashion similar to that illustrated by FIGS. 2 and 3. Process 400 then proceeds to step 424. If the answer to the query at step 418 is "yes", process 400 proceeds to step 422. At step 422, no data for the given subgroup of the current row of image data is provided to input controller 38, again in a fashion similar to FIGS. 2 and 3. Process 400 then proceeds to step 424.

At step 424, process 400 queries whether the given subgroup is the last subgroup of the current row of image data. If the answer is "no", process 400 increments at step 426 to the next subgroup of the current row of image data and returns to step 414. If the answer is "yes", process 400 proceeds to step 428.

At step 428, process 400 queries whether the current row of image data is the last row of image data of the current frame of image data. If the answer is "no", process 400 increments to the next row of image data of the current frame of image data and returns to step 412. If the answer is "yes", process 400 returns to step 404 where input controller 36 receives the next frame of image data in the series of groups of frame data.

In summary, data control system 30 according to the present invention reduces data rates to light modulating displays, such as a digital projector system, by providing only data that changes from one frame to the next in those situations where the amount of data changing is less than a predetermined threshold amount. In such situations, data rates are reduced without creating quality-reducing visual artifacts produced by currently employed data input algorithms. Furthermore, in those situations where the amount of image data changing from frame-to-frame is beyond the visual comprehension of a user, data control system 30 reducing data rates by reducing the spatial resolution of the light modulating display in a manner not perceivable to a user.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A system for controlling display cells modulating light based on data, the system comprising:

an input controller configured to receive a series of data groups with each having N bits and arranged in subgroups, each subgroup having a subgroup value and a subgroup position with each position corresponding to one cell of a group of cells, to determine a comparison value for each subgroup position based on subgroup values at corresponding subgroup positions of a current data group and a preceding data group, to provide an update signal based on the comparison values, and to provide an update data group having less than N bits and representative of the current data group when the update signal indicates reduced data transmission; and a display controller configured to receive the update signal and the update data group and to update the group of cells based on the update signal with N bits of data from at least one of:

the update data group;

the preceding data group; and a function of the update and preceding data groups.

2. The system of claim 1, wherein the preceding data group is a data group immediately preceding the current data group in the series of data groups.

3. The system of claim 1, wherein the input controller further comprises:

a memory storing the preceding image data group.

4. The system of claim 1, wherein the display controller further comprises:

a memory storing the preceding image data group.

5. The system of claim 1, wherein each data group comprises a row of image data representative of a displayable image, wherein the group of cells comprises a row of light modulating cells of a light modulating array, and wherein each subgroup of the row of image data corresponds to one light modulating cell of the row of light modulating cells.

6. The system of claim 5, wherein the comparison value of a subgroup position of a current row of image data is based on a comparison of the subgroup value of the subgroup position of the current row of image data to a subgroup value at a corresponding subgroup position of a preceding row of image data.

7. The system of claim 6, wherein the update signal indicates which subgroup positions of a current row of image data have subgroup values that match and which subgroup positions have subgroup values that do not match the subgroup value of the corresponding subgroup position of the preceding row of image data.

8. The system of claim 7, wherein the update signal comprises:

a status bit corresponding to each subgroup position of the current row of data, wherein each bit has a first state indicating when the associated subgroup value does not match and a second state when the associated subgroup value does matches the subgroup value at the corresponding subgroup position of the preceding row of image data.

9. The system of claim 7, wherein the update data group comprises:

subgroups of the current row of image data having subgroup values that do not match the subgroup values of corresponding subgroup positions of the preceding row of image data.

10. The system of claim 9, wherein the display controller, when an update signal status bit has the first state, provides a subgroup from the update data group having a same subgroup position as the status bit to a corresponding light modulating cell of a row of cells, and when an update signal status bit has the second state, provides a subgroup of the preceding row of image data having a same subgroup position as the status bit to a corresponding light modulating cell of the row of cells.

11. The system of claim 5, wherein the comparison value of each subgroup position of a current row of image data comprises a difference value between the subgroup value of the subgroup position of the current row of image data and a subgroup value at a corresponding subgroup position of a preceding row of image data.

12. The system of claim 11, wherein the update signal indicates which subgroup positions of a current row of image data have an associated difference value having an absolute value at least equal to a predetermined threshold difference value, and which subgroup positions have an associated difference value less than the predetermined threshold difference value.

13. The system of claim 12, wherein the update signal comprises:

a status bit corresponding to each subgroup position of the current row of data, wherein each bit has a first state indicating when the associated difference value has an absolute value at least equal to the predetermined threshold difference value and a second state indicating when the associated difference value has an absolute value less than the predetermined threshold difference value.

14. The system of claim 12, wherein the update data group comprises:

subgroups of the current row of image data having an associated difference values with absolute values at least equal to the threshold difference value, and the difference values of subgroups wherein the absolute value of the difference value is less than the predetermined threshold difference value.

15. The system of claim 14, wherein the display controller, when an update signal status bit has the first state, provides a subgroup from the update data group having a same subgroup position as the status bit to a corresponding light modulating cell of a row of cells, and when an update signal status bit has the second state, provides a subgroup comprising a sum of a difference value from the update data group and a subgroup from the preceding row of image data having a same subgroup position as the status bit to a corresponding light modulating cell of the row of cells.

16. The system of claim 1, wherein each data group comprises a frame of image data representative of a displayable image, wherein the group of cells comprises an array of light modulating cells, and wherein each subgroup of the frame of image data corresponds to one light modulating cell of the array of light modulating cells.

17. The system of claim 16, wherein the comparison value of a subgroup position of a current frame of image data is based on a comparison of the subgroup value of the subgroup position of the current frame of image data to a subgroup value at a corresponding subgroup position of a preceding frame of image data.

18. The system of claim 17, wherein the update signal has a first state when a percentage of a total number of subgroup positions of the current frame of image data having subgroup values not matching subgroup values of corresponding subgroup positions of a preceding frame of image data is not greater than a predetermined threshold percentage, and a second state when the percentage exceeds the predetermined threshold percentage.

19. The system of claim 18, wherein the update data group comprises:

the current frame of image data when the update signal has the first state, and a quantity of representative subgroups less than the number of subgroup positions of the current frame of image data and having subgroup values based on the subgroup values of the current fame of image data when the update signal has the second state.

20. The system of claim 19, wherein each of the representative subgroups of the update data group has a subgroup value comprising an average of the subgroup values of a corresponding predetermined group of subgroup positions of the current frame of image data.

21. The system of claim 19, wherein each of the representative subgroups of the update data group has a subgroup value comprising the subgroup value of a predetermined subgroup position of the current frame of image data.

22. The system of claim 19, wherein the display controller provides each subgroup of the current frame of data to the corresponding light modulating cell of the light modulating array when the update signal has the first state, and provides each of the representative subgroups to at least two of the light modulating cells of the light modulating array.

23. A display system comprising:

a display having cells modulating light based on data;

an input controller configured to receive a series of data groups with each having N bits and arranged in subgroups, each subgroup having a subgroup value and a subgroup position with each position corresponding to one cell of a group of cells, to determine a comparison value for each subgroup position based on subgroup values at corresponding subgroup positions of a current data group and a preceding data group, to provide an update signal based on the comparison values, and to provide an update data group having less than N bits and representative of the current data group when the update signal indicates reduced data transmission; and a display controller configured to receive the update signal and the update data group and to update the group of cells based on the update signal with N bits of data from at least one of:

the update data group;

the preceding data group; and a function of the update and preceding data groups.

24. A system for controlling a display having cells modulating light based on image data, the system comprising:

an input controller configured to receive a series of image data groups with each image data group having N subgroups, each subgroup having a subgroup position and a subgroup value, with each subgroup position corresponding to one cell of a group of N cells, to provide an update signal indicating which subgroup positions of a current image data group have subgroup values that substantially match subgroup values at corresponding subgroup positions of a preceding image data group, and to provide an update image data group based on subgroups of the current image data group having subgroup values not substantially matching subgroup values at corresponding subgroup positions of the preceding image data group; and a display controller configured to receive the update signal and the update image data group and to update the group of N cells with N subgroups each comprising image data from the update and/or preceding image data groups based on the update signal.

25. The system of claim 24, wherein the preceding data group is a data group immediately preceding the current data group in the series of data groups.

26. The system of claim 24, wherein the input controller further comprises:

a memory storing the preceding image data group.

27. The system of claim 24, wherein the display controller further comprises:

a memory storing the preceding image data group.

28. The system of claim 24, wherein each data group comprises a row of image data representative of a displayable image, wherein the group of N cells comprises a row of light modulating cells of a light modulating array, and wherein each of the N subgroups of the row of image data corresponds to one light modulating cell of the row of N light modulating cells.

29. The system of claim 28, wherein the comparison value of a subgroup position of a current row of image data is based on a comparison of the subgroup value of the subgroup position of the current row of image data to a subgroup value at a corresponding subgroup position of a preceding row of image data.

30. The system of claim 29, wherein the update signal indicates which subgroup positions of a current row of image data have subgroup values that match and which subgroup positions have subgroup values that do not match the subgroup value of the corresponding subgroup position of the preceding row of image data.

31. The system of claim 30, wherein the update signal comprises:

a status bit corresponding to each subgroup position of the current row of image data, wherein each bit has a first state indicating when the associated subgroup value does not match and a second state when the associated subgroup value does matches the subgroup value at the corresponding subgroup position of the preceding row of image data.

32. The system of claim 30, wherein the update data group comprises:

subgroups of the current row of image data having subgroup values that do not match the subgroup values of corresponding subgroup positions of the preceding row of image data.

33. The system of claim 32, wherein the display controller, when an update signal status bit has the first state, provides a subgroup from the update data group having a same subgroup position as the status bit to a corresponding light modulating cell of a row of cells, and when an update signal status bit has the second state, provides a subgroup of the preceding row of image data having a same subgroup position as the status bit to a corresponding light modulating cell of the row of cells.

34. A system for controlling display cells modulating light based on data, the system comprising:

an input controller configured to receive a series of data groups with each data group having N subgroups, each subgroup having a subgroup position and a subgroup value, with each subgroup position corresponding to one cell of a group of N cells, to determine difference values between subgroup values of a current data group and subgroup values at corresponding subgroup positions of a preceding data group, to provide an update signal indicating subgroup positions at which difference values are below a threshold value, and to provide update data comprising subgroups from subgroup positions of the current data group at which difference values at least equal the threshold value and the difference values when less than the threshold level; and a display controller configured to receive the update signal and the update data, and to update the group of N cells with N subgroups each comprising data from the update data and/or preceding data group based on the update signal.

35. The system of claim 34, wherein the preceding data group is a data group immediately preceding the current data group in the series of data groups.

36. The system of claim 34, wherein the input controller further comprises:

a memory storing the preceding image data group.

37. The system of claim 34, wherein the display controller further comprises:

a memory storing the preceding image data group.

38. The system of claim 34, wherein each data group comprises a row of image data representative of a displayable image, wherein the group of cells comprises a row of light modulating cells of a light modulating array, and wherein each subgroup of the row of image data corresponds to one light modulating cell of the row of light modulating cells.

39. The system of claim 38, wherein the comparison value of each subgroup position of a current row of image data comprises a difference value between the subgroup value of the subgroup position of the current row of image data and a subgroup value at a corresponding subgroup position of a preceding row of image data.

40. The system of claim 39, wherein the update signal indicates which subgroup positions of a current row of image data have an associated difference value having an absolute value at least equal to a predetermined threshold difference value, and which subgroup positions have an associated difference value less than the predetermined threshold difference value.

41. The system of claim 40, wherein the update signal comprises:

a status bit corresponding to each subgroup position of the current row of data, wherein each bit has a first state indicating when the associated difference value has an absolute value at least equal to the predetermined threshold difference value and a second state indicating when the associated difference value has an absolute value less than the predetermined threshold difference value.

42. The system of claim 40, wherein the update data group comprises:

subgroups of the current row of image data having an associated difference values with absolute values at least equal to the threshold difference value, and the difference values of subgroups wherein the absolute value of the difference value is less than the predetermined threshold difference value.

43. The system of claim 42, wherein the display controller, when an update signal status bit has the first state, provides a subgroup from the update data group having a same subgroup position as the status bit to a corresponding light modulating cell of a row of cells, and when an update signal status bit has the second state, provides a subgroup comprising a sum of a difference value from the update data group and a subgroup from the preceding row of image data having a same subgroup position as the status bit to a corresponding light modulating cell of the row of cells.

44. A system for controlling a display having cells modulating light based on data, the system comprising:

an input controller configured to receive a series of data groups with each data group having N subgroups, each subgroup having a subgroup position and a subgroup value, with each subgroup position corresponding to one cell of a group of N cells; to provide an update signal having a first state when a percentage of N subgroup positions of a current data group having values not matching subgroup values at corresponding subgroup positions of a preceding data group exceeds a threshold percentage, and when the update signal has the first state to provide an update data group having less than N subgroups having subgroup values based on the current data group; and a display controller configured to receive the update signal and the update data group and to update the group of N cells with the update data group such that at least one subgroup is provided to more than one of the N cells when the update signal has the first state.

45. The system of claim 44, wherein the preceding data group comprises a data group immediately preceding the current data group in the series of data groups.

46. The system of claim 44, wherein the input controller further comprises:

a memory storing the preceding image data group.

47. The system of claim 44, wherein each data group comprises a frame of image data representative of a displayable image, wherein the group of N cells comprises an array of light modulating cells, and wherein each of the N subgroups of the frame of image data corresponds to one light modulating cell of the array of N light modulating cells.

48. The system of claim 47, wherein the comparison value of a subgroup position of a current frame of image data is based on a comparison of the subgroup value of the subgroup position of the current frame of image data to a subgroup value at a corresponding subgroup position of a preceding frame of image data.

49. The system of claim 48, wherein the update signal has a first state when a percentage of the N subgroup positions of the current frame of image data having subgroup values not matching subgroup values of corresponding subgroup positions of a preceding frame of image data is not greater than a predetermined threshold percentage, and a second state when the percentage exceeds the predetermined threshold percentage.

50. The system of claim 49, wherein the update data group comprises:

the current frame of image data when the update signal has the first state, and a quantity of representative subgroups less than the N subgroup positions of the current frame of image data and having subgroup values based on the subgroup values of the current fame of image data when the update signal has the second state.

51. The system of claim 50, wherein each of the representative subgroups of the update data group has a subgroup value comprising an average of the subgroup values of a corresponding predetermined group of subgroup positions of the current frame of image data.

52. The system of claim 50, wherein each of the representative subgroups of the update data group has a subgroup value comprising the subgroup value of a predetermined subgroup position of the current frame of image data.

53. The system of claim 50, wherein the display controller provides each subgroup of the current frame of data to the corresponding light modulating cell of the light modulating array when the update signal has the first state, and provides each of the representative subgroups to at least two of the light modulating cells of the light modulating array when the update signal has the second state.

54. A method of reducing data rates to a display device having display cells modulating light based on image data, the method comprising:

receiving a series of image data groups, with each image data group having N bits arranged in subgroups, each subgroup having a subgroup value and a subgroup position, with each subgroup position corresponding to one cell of a group of cells;

determining a comparison value for each subgroup position based on subgroup values of corresponding subgroup positions of a current image data group and a preceding image data group;

providing to the display device an update signal based on the comparison values; and providing to the display device an update image data group having less than N bits and representative of the current image data group when the update signal indicates reduced data transmission.

55. The method of claim 54, further comprising:

updating the group of cells based on the update signal with N bits of data from at least one of:

the update image data group;

the preceding image data group; and a function of the update and preceding image data groups.

56. A method of reducing data rates to a display device having cells modulating light based on image data, the method comprising:

receiving a series of image data groups with each image data group having N subgroups, each subgroup having a subgroup position and a subgroup value, with each subgroup position corresponding to one cell of a group of N cells; and providing to the display device an update image data group having subgroups comprising only those subgroups of a current image data group having subgroup values not matching subgroup values at corresponding subgroup positions of a preceding image data group.

57. The method of claim 56, further comprising:

providing to the display device an update signal indicating subgroup positions of the current image data group at which subgroup values match and subgroup positions of the current image data group at which subgroup value do not match subgroup values at corresponding subgroup positions of the preceding image data group.

58. The method of claim 57, further comprising:

updating each cell of the group of N cells with a corresponding subgroup of the update image data group or the preceding image data group based on the update signal.

59. A method of reducing data rates to a display device having cells modulating light based on image data, the method comprising:

receiving a series of image data groups with each image data group having N subgroups, each subgroup having a subgroup position and a subgroup value, with each subgroup position corresponding to one cell of a group of N cells;

determining a difference value between each subgroup value of a current image data group and a subgroup value at a corresponding subgroup position of a preceding image data group;

providing to the display device an update image data group comprising subgroups of the current image data group from subgroup positions at which the difference value has an absolute value at least equal to a threshold value and difference values only from subgroup positions at which the difference value has an absolute value less than the threshold value.

60. The method of claim 59, further comprising providing to the display device an update signal indicating which subgroup positions of the current image data group have a difference value with an absolute value at least equal to the threshold value and which subgroup positions of the current image data group have a difference value with an absolute value less than the threshold value.

61. The method of claim 60, further comprising:

updating each cell of the group of N cells with N subgroups each comprising image data from the update image data group and/or the preceding data group based on the update signal.

62. A method of reducing data rates to a display device having cells modulating light based on image data, the method comprising:

receiving a series of image data groups with each image data group having N subgroups, each subgroup having a subgroup position and a subgroup value, with each subgroup position corresponding to one cell of a group of N cells;

determining a percentage of subgroup values of the current image data group not matching a corresponding subgroup value of a preceding image data group; and providing to the display device an update image data group comprising:

less than N subgroups of image data when the percentage exceeds a threshold percentage, wherein each of the less than N subgroups of image data has a subgroup value based on the subgroup values of the current image data group, and the N subgroups of the current image data group when the percentage is not greater than the threshold percentage.

63. The method of claim 62, further comprising:

providing to the display device an update signal having a first state when the percentage is not greater than the threshold percentage and a second state when the percentage exceeds the threshold percentage.

64. The method of claim 63, further comprising:

updating each cell of the group of N cells with the corresponding subgroup of the update image data group when the update signal is at the first state, and updating the cells of the group of N cells with the less than N subgroups of the update image data group when the update signal is at the second state, wherein each of the less than N subgroups is provided to more than one cell of the group of N cells.

65. A portable electronic device comprising:

display cells modulating light based on data; and the system of claim 1 for controlling the display cells.

66. A notebook computer comprising:

display cells modulating light based on data; and the system of claim 1 for controlling the display cells.

67. A cell phone comprising:

a projector having display cells modulating light based on data; and the system of claim 1 for controlling the display cells.

68. A handheld electronic device comprising:

a projector having display cells modulating light based on data;

the system of claim 1 for controlling the display cells.

69. An electronic device comprising:

a removable display module including:

display cells modulating light based on data; and the system of claim 1 for controlling the display cells.

70. An input controller adapted to couple to an array system having display cells modulating light based on data, the input controller configured to receive a series of data groups with each having N bits arranged in subgroups, each subgroup having a subgroup value and a subgroup position with each position corresponding to one display cell of a group of display cells, to determine a comparison value for each subgroup position based on subgroup values at corresponding subgroup positions of a current data group and a preceding data group, to provide an update signal based on the comparison values, and to provide an update data group having less than N bits and representative of the current data group when the update signal indicates reduced data transmission.

71. The input controller of claim 70, wherein the preceding data group is a data group immediately preceding the current data group in the series of data groups.

72. The input controller of claim 70 further comprising a memory for storing the preceding data group.

73. The input controller of claim 70, wherein each data group comprises a row of image data representative of a displayable image, wherein the group of cells comprises a row of light modulating cells of a light modulating array, and wherein each subgroup of the row of image data corresponds to one light modulating cell of the row of light modulating cells.

74. The input controller of claim 71, wherein the comparison value of a subgroup position of a current row of image data is based on a comparison of the subgroup value of the subgroup position of the current row of image data to a subgroup value at a corresponding subgroup position of a preceding row of image data.

75. The input controller of claim 71, wherein the comparison value of each subgroup of a current row of image data comprises a difference value between the subgroup value of the subgroup position of the current row of image data and a subgroup value at a corresponding subgroup position of a preceding row of image data.

76. The input controller of claim 70, wherein each data group comprises a frame of image data representative of a displayable image, wherein the group of cells comprises an array of light modulating cells, and wherein each subgroup of the frame of image data corresponds to one light modulating cell of the array of light modulating cells.

77. An array system comprising:

display cells modulating light based on data; and a display controller configured to receive an update signal and an update data group, wherein the update signal is based on comparison values derived from subgroup values at subgroup group positions of a current data group of a series of data groups and subgroup values at corresponding subgroup positions of a preceding data group of the series with each data group of the series having N bits arranged in subgroups and each subgroup having a subgroup value and a subgroup position corresponding to one display cell of a group of display cells and wherein the update data group has less than N bits is representative of the current data group when the update signal indicates reduced data transmission, and configured to update the group of display cells based on the update signal with N bits from at least one of:

the update data group;

the preceding data group; and a function of the update and preceding data groups.

78. The array system of claim 77 further comprising a memory for storing the preceding data group.

* * * * *